US005814274A

United States Patent [19]

Komai et al.

[11] Patent Number: 5,814,274

[45] Date of Patent: Sep. 29, 1998

[54] LOW-CR FERRITIC STEELS AND LOW-CR FERRITIC CAST STEELS HAVING EXCELLENT HIGH TEPERATURE STRENGTH AND WELDABILITY

[75] Inventors: Nobuyoshi Komai; Fujimitsu Masuyama, both of Nagasaki-ken; Tomomitsu Yokoyama, Tokyo, all of Japan

[73] Assignee: Mitsubishi Jukogyo Kabushiki Kaisha, Tokyo, Japan

[21] Appl. No.: 803,595

[22] Filed: Feb. 21, 1997

[30] Foreign Application Priority Data

Jun. 24, 1996 [JP] Japan ..... 8-162790

[51] Int. Cl.[6] ..... C22C 38/44; C22C 38/48

[52] U.S. Cl. ..... 420/106; 420/109

[58] Field of Search ..... 148/335; 420/82, 420/106, 109

[56] References Cited

U.S. PATENT DOCUMENTS 5,407,635 4/1995 Iseda et al. ..... 420/109

FOREIGN PATENT DOCUMENTS 1 052 150 A 6/1991 China .

0 639 691 A1 2/1995 European Pat. Off. .

*Primary Examiner*—Deborah Yee

*Attorney, Agent, or Firm*—Foley & Lardner

[57] ABSTRACT

This invention provides low-Cr ferritic steels and low-Cr ferritic cast steels having excellent high-temperature strength and weldability. These low-Cr ferritic steels and low-Cr ferritic cast steels consist essentially of, on a weight percentage basis, 0.03 to 0.12% C, 0.05 to 0.7% Si, 0.05 to 1% Mn, 0.002 to 0.025% P, 0.001 to 0.015% S, 0.3 to 3% Cr, 0.01 to 1% Ni, 0.05 to 3% Mo, 0.01 to 0.5% V, 0.1 to 3% W, 0.01 to 0.2% Nb, 0.02 to 1.5% Re, 0.003 to 0.05% Al, 0.0001 to 0.01% B, 0.003 to 0.03% N, and the balance being Fe and incidental impurities, and have excellent high-temperature strength and weldability.

24 Claims, No Drawings

LOW-CR FERRITIC STEELS AND LOW-CR FERRITIC CAST STEELS HAVING EXCELLENT HIGH TEPERATURE STRENGTH AND WELDABILITY

BACKGROUND OF THE INVENTION

1. Field of the Invention

This invention relates to low-Cr ferritic steels and low-Cr ferritic cast steels which have excellent high-temperature strength, weldability, oxidation resistance and high-temperature corrosion resistance and are suitable for use as members used in a high-temperature environment at or above 450° C. and as casting materials, respectively, in the fields of boilers, nuclear power industry, chemical industry and the like.

2. Description of the Related Art

Materials for use as heat-resisting and pressure-tight members in boilers, chemical industry, nuclear power industry and the like include austenitic stainless steels, high-Cr ferritic steels having a Cr content of 9 to 12%, low-Cr ferritic steels typified by 2·1/4Cr—1Mo steel and 1Cr—0.5Mo steel, and carbon steel. (In this specification, the contents of alloy components are all expressed as weight percentages.) These materials are selected according to the service temperature, pressure and environment of the particular member and with consideration for economic efficiency. Generally, they exhibit more excellent corrosion resistance and oxidation resistance as their Cr content becomes higher, and many of them also exhibit excellent high-temperature strength. For the above-described reason, expensive materials having a high Cr content may sometimes be used even in locations not requiring very high corrosion resistance, because of their excellent high-temperature strength. Moreover, there are many heat-resisting materials which are excellent in high-temperature strength but poor in weldability. As compared with high-Cr ferritic steels, low-Cr ferritic steels have a lower Cr content and are hence less expensive. Accordingly, low-Cr ferritic steels can advantageously be used in locations where corrosion resistance is not of great interest, provided that their high-temperature strength is equal to or higher than that of high-Cr ferritic steels.

As compared with forged steels, cast steels have the advantage that they do not require a forging step and that they can be easily formed into articles of complicated shapes and hence require a less working cost. With the recent progress of casting techniques, the reliability of cast steels which was apprehended in the past has made a marked improvement. However, when the high-temperature strength of cast steels is compared with that of forged steels containing the same amount of Cr and having substantially the same chemical composition, forged steels generally have higher strength. Accordingly, forged steels are often used in spite of their disadvantage in cost.

SUMMARY OF THE INVENTION

In view of the above-described problems of the prior art, an object of the present invention is to provide low-Cr ferritic steels and cast steels as described below. More specifically, it is an object of the present invention to provide low-Cr ferritic steels which show a marked improvement in high-temperature creep strength at temperatures of 450° C. and above, also have performance equal to or higher than that of conventional low-alloy steels with respect to toughness, workability and weldability, and can be substituted for high-Cr ferritic steels. It is another object of the present invention to provide low-Cr ferritic cast steels which show a marked improvement in high-temperature creep strength over conventional cast steels, and also have performance equal to or higher than that of forged steels with respect to toughness and weldability.

The present inventors repeated a large number of investigations on high-temperature strength and weldability, while considering the precipitation effects of V and Nb and the solid solution strengthening and fine carbide precipitation effects of W, Mo and Re, and while considering the amounts of C, Mn and B added from the viewpoint of weldability. As a result, the present invention has been completed.

That is, the present invention relates to low-Cr ferritic steels and low-Cr ferritic cast steels having added thereto Re that has not been conventionally used as an additional element. More specifically, the present invention provides the following three types of steels.

(1) A low-Cr ferritic steel consisting essentially of, on a weight percentage basis, 0.03 to 0.12% C, 0.05 to 0.7% Si, 0.05 to 1% Mn, 0.002 to 0.025% P, 0.001 to 0.015% S, 0.8 to 3% Cr, 0.01 to 1% Ni, 0.05 to 3% Mo, 0.01 to 0.5% V, 0.1 to 3% W, 0.01 to 0.2% Nb, 0.1 to 1.5% Re, 0.003 to 0.05% Al, 0.0001 to 0.01% B, 0.003 to 0.03% N, and the balance being Fe and incidental impurities, and having excellent high-temperature strength and weldability.

(2) A low-Cr ferritic steel consisting essentially of, on a weight percentage basis, 0.03 to 0.12% C, 0.05 to 0.7% Si, 0.05 to 1% Mn, 0.002 to 0.025% P, 0.001 to 0.015% S, 0.3 to 1.5% Cr, 0.01 to 1% Ni, 0.05 to 3% Mo, 0.01 to 0.5% V, 0.1 to 3% W, 0.01 to 0.2% Nb, 0.02 to 1.5% Re, 0.003 to 0.05% Al, 0.0001 to 0.01% B, 0.003 to 0.03% N, and the balance being Fe and incidental impurities and having excellent high-temperature strength and weldability.

(3) A low-Cr ferritic cast steel consisting essentially of, on a weight percentage basis, 0.03 to 0.12% C, 0.05 to 0.7% Si, 0.05 to 1% Mn, 0.002 to 0.025% P, 0.001 to 0.015% S, 0.8 to 3% Cr, 0.01 to 1% Ni, 0.05 to 3% Mo, 0.01 to 0.5% V, 0.1 to 3% W, 0.01 to 0.2% Nb, 0.02 to 1.5% Re, 0.003 to 0.05% Al, 0.0001 to 0.01% B, 0.003 to 0.03% N, and the balance being Fe and incidental impurities and having excellent high-temperature strength and weldability.

The low-Cr ferritic steels of the present invention markedly improves the high-temperature strength of conventional low-alloy steels, and have high-temperature strength equal to or greater than that of high-Cr ferritic steels and excellent weldability.

The low-Cr ferritic steels of the present invention can be expected to be useful as substitute materials for high-Cr ferritic steels, because of their high-temperature strength. Moreover, since they have excellent weldability, their preheating during welding may be omitted. Thus, they are useful as materials also having excellent toughness, workability and economical efficiency which are merits of ferritic steels, and can be applied to the making of forged articles of tubular, plate-like and various other shapes for use as heat-resisting pressure-tight members in industrial fields such as boilers, chemical industry and nuclear power industry.

The low-Cr ferritic cast steels of the present invention markedly improves the high-temperature strength of conventional low-alloy cast steels, and also have excellent impact properties and weldability. Accordingly, they are cheaper materials which can be substitutionally used in locations where forged steel has conventionally been used. The cast steels of the present invention can be applied to the making of cast articles of tubular, plate-like and various other shapes for use as heat-resisting pressure-tight members in industrial fields such as boilers, chemical industry and nuclear power industry. In the present application, "C" stands for carbon, "Cr" chromium, "Fe" iron, "W" tungsten, "V" vanadium, "Nb" niob, "Mo" molybdenum and "Re" rhenium.

DETAILED DESCRIPTION OF PREFERRED EMBODIMENTS

The action of various components in the low-Cr ferritic steels and low-Cr ferritic cast steels of the present invention, and the reasons for the selection of their content ranges are described below.

C combines with Cr, Fe, W, V, Nb, Mo and Re to form carbides and thereby contributes to the improvement of high-temperature strength. At the same time, C itself acts as an austenite-stabilizing element to stabilize the structure. If its content is less than 0.03% by weight, the precipitation of carbides will be insufficient to achieve adequate high-temperature strength. If its content is greater than 0.12% by weight, excessive amounts of carbides will precipitate, resulting in marked hardening of the steel and hence poor workability. Moreover, high C contents will also bring about poor weldability. Accordingly, the proper content of C should be in the range of 0.03 to 0.12% by weight. In view of weldability, the preferred range is from 0.04 to 0.08% by weight.

Si is an element which acts as a deoxidizer and improves steam oxidation resistance. If its content is exceeds 0.7% by weight, Si will cause a marked reduction in toughness and will be detrimental to creep strength. Since Si promotes temper embrittlement especially in the case of thick-wall materials, its content should be in the range of 0.05 to 0.7% by weight. In the case of cast steel, the range of 0.15 to 0.60% by weight is preferred in consideration of melt flowability during casting.

Mn has desulfurizing and deoxidizing effects, improves the hot workability of steel, and is effective in stabilizing the structure. If its content is less than 0.05% by weight, no sufficient effect will be produced. If its content is greater than 1% by weight, Mn will harden the steel and detract from its workability. Moreover, similarly to Si, Mn will enhance sensitivity to temper embrittlement. When the S content is particularly low, the Mn content can be reduced. Accordingly, the content of Mn should be in the range of 0.05 to 1% by weight. In view of high temperature strength, the more preferred range is from 0.05 to 0.40% by weight.

Both P and S are elements which are detrimental to toughness and workability. Since even a very slight amount of S destabilizes grain boundaries and $Cr_2O_3$ scale film and thereby causes a reduction in strength, toughness and workability, its contents should preferably be as low as possible. As inevitable contents, the contents of P and S have been chosen to be in the range of 0.002 to 0.025% by weight and 0.001 to 0.015% by weight, respectively.

Cr is an element which is indispensable from the viewpoint of the oxidation resistance and high-temperature corrosion resistance of low-alloy steels. For services at high temperatures of 500° C. or above, Cr contents of less than 0.8% by weight will fail to produce sufficient oxidation resistance and high-temperature corrosion resistance. On the other hand, Cr contents of greater than 3% by weight will bring about a further improvement in oxidation resistance and high-temperature corrosion resistance, but will cause a reduction in strength and toughness. Moreover, it is desirable from an economic point of view to minimize the amount of Cr added. Accordingly, its upper limit has been chosen to be 3% by weight. When the service temperature is relatively low (i.e., 450°–600° C.), the content of Cr may be lower. In order to make the most of the advantageous cheapness of low-Cr ferritic steels, the content of Cr may be chosen to be in the range of 0.3 to 1.5% by weight.

Ni is an austenite-stabilizing element and contributes to the improvement of toughness. However, if its content exceeds 1% by weight, Ni will detract from high-temperature creep strength. Moreover, the addition of large amounts of Ni is also disadvantageous from an economic point of view. Accordingly, the content of Ni should be in the range of 0.01 to 1% by weight. The more preferred range is from 0.05 to 0.30% by weight.

Mo, like W, is effective for improvement of creep strength. Mo produces a strength-improving effect when added in combination with W, and is also effective for the improvement of toughness when added in small amounts. It the content of Mo is less than 0.05% by weight, the above-described effects will not be produced. If its content is greater than 3% by weight, intermetallic compounds will precipitate at high temperature, resulting in not only a reduction in toughness but also the loss of its effect on strength. Accordingly, when Mo is added, its content should be in the range of 0.05 to 3% by weight. And, when W is added more than 1% by weight, the content of Mo can be in the range of 0.05 to 0.5% by weight.

V combines with C and N to form a fine precipitate comprising V(C,N) and the like. This precipitate contributes greatly to the improvement of long-time creep strength. However, if its content is less than 0.01% by weight, no sufficient effect will be produced. If its content is greater than 0.5% by weight, the precipitation of V(C,N) will be excessive and, on the contrary, cause a reduction in creep strength and toughness. Accordingly, the proper content of V should be in the range of 0.01 to 0.5% by weight. In view of the balance between strength property and toughness, the preferred range is from 0.15 to 0.30% by weight.

W acts as a solid solution strengthening and fine carbide precipitation strengthening element and is effective for improvement of creep strength. Although Mo has a similar effect, W has a lower diffusion rate in Fe and is hence more excellent in the high-temperature stability of its fine carbide which contributes to the improvement of creep strength. When added in combination with Mo, W brings about a greater improvement in strength, particularly high-temperature creep strength, than when added alone. If its content is less than 0.1% by weight, no effect will be produced, and if its content is greater than 3% by weight, W will harden the steel and detract from its workability. Accordingly, the content of W should be in the range of 0.1 to 3% by weight.

Nb, like V, combines with C and N to form Nb(C,N) and thereby contributes to the improvement of creep strength. In particular, Nb shows a marked strength-improving effect at relatively low temperatures of 600° C. or below. It its content is less than 0.01% by weight, the above-described effect will not be produced. If its content is greater than 0.2% by weight, the amount of Nb(C,N) not in solid solution will increase, harden the steel significantly, and detract from its toughness, workability and weldability. Accordingly, the content of Nb should suitably be in the range of 0.01 to 0.2% by weight. And, in view of creep strength and toughness, the content of 0.03 to 0.10% by weight is preferred.

Re improves creep strength in proportion to its content, but its content has been chosen to be in the range of 0.02 to 1.5% by weight from an economic point of view. For low-Cr ferritic steels which are used at relatively high temperatures and hence require high creep strength, the lower limit of the Re content has been chosen to be 0.1% by weight. Since low-Cr ferritic steels having a relatively low Cr content (i.e., 0.3 to 1.5% by weight) are not used at very high temperatures owing to their limited oxidation resistance, very high creep strength is not required. Accordingly, the lower limit of the Re content has been chosen to be 0.02% by weight. Moreover, for low-Cr ferritic cast steels having less severe creep strength requirements than steel, the lower limit of the Re content has also been chosen to be 0.02% by weight. Considering the balance between high temperature strength and economy, the upper limit of the Re content can be 0.07% by weight.

Al is an indispensable deoxidizing element. If its content is less than 0.003% by weight, no effect will be produced, and if its content is greater than 0.05% by weight, Al will detract from creep strength and workability. Accordingly, the content of Al should be in the range of 0.003 to 0.05% by weight. The more preferred range is from 0.003 to 0.01% by weight.

The addition of a very slight amount of B has the effect of dispersing and stabilizing carbides and thereby contributes to the improvement of long-time creep strength. If its content is less than 0.0001% by weight, no sufficient effect will be produced, and if its content is greater than 0.01% by weight, B will detract from workability. Accordingly, B should be added so as to give a B content in the range of 0.0001 to 0.01% by weight. Even in this range, the addition of B is effective for the improvement of hardenability. Consequently, it is necessary from the viewpoint of structure control to adjust the amount of B added as required.

N is necessary for the formation of carbonitrides by combination with V and Nb. If its content is less than 0.003% by weight, no effect will be produced. However, as its content becomes higher, N in solid solution will increase and the nitrides will coarsen, resulting in a reduction in creep strength, toughness and workability. Accordingly, the content of N should be not greater than 0.03% by weight. Thus, the content of N has been chosen to be in the range of 0.003 to 0.03% by weight. In view of toughness, the content of 0.003 to 0.01% by weight is preferred.

The present invention is more specifically explained with reference to the following examples.

EXAMPLE 1

50 kg each of steels having the respective chemical compositions shown in Table 1 were melted in a vacuum melting furnace, and the resulting ingots were forged at 1,150°–950° C. to form plates having a thickness of 20 mm. In Table 1, Nos. 1 and 2 are typical conventional low-Cr ferritic steels which have compositions corresponding to those of STBA 22 and STBA 24, respectively. Nos. 3 to 5 are comparative steels prepared by adding V and Nb to steel Nos. 1 and 2. Nos. 6 to 17 are low-Cr ferritic steels in accordance with the present invention.

As a conventional heat treatment, steel Nos. 1 and 2 were normalized by heating at 920° C. for 1 hour and air cooling (AC), and then tempered by heating at 740° C. for 1 hour and air cooling (AC). Steel Nos. 3 to 17 were normalized by heating at 1,050° C. for 1 hour and air cooling (AC), and then tempered by heating at 770° C. for 1 hour and air cooling (AC).

TABLE 1

Chemical compositions of samples (comparative steels and inventive steels) (wt. %)

| | No. | C | Si | Mn | Ni | Cr | W | Mo | V | Nb | Re | Al | B | N | P | S |
|---|---|---|---|---|---|---|---|---|---|---|---|---|---|---|---|---|
| Comparative steels | 1 | 0.13 | 0.36 | 0.45 | 0.010 | 0.95 | — | 0.56 | — | — | — | 0.003 | — | 0.011 | 0.018 | 0.006 |
| | 2 | 0.12 | 0.34 | 0.45 | 0.010 | 2.19 | — | 0.98 | — | — | — | 0.006 | — | 0.016 | 0.014 | 0.003 |
| | 3 | 0.12 | 0.30 | 0.56 | 0.012 | 1.01 | — | 0.54 | 0.27 | 0.06 | — | 0.005 | — | 0.012 | 0.010 | 0.005 |
| | 4 | 0.13 | 0.33 | 0.44 | 0.009 | 2.24 | — | 1.01 | 0.23 | 0.07 | — | 0.007 | — | 0.010 | 0.011 | 0.007 |
| | 5 | 0.13 | 0.35 | 0.58 | 0.015 | 2.84 | — | 0.92 | 0.30 | 0.07 | — | 0.006 | — | 0.014 | 0.015 | 0.004 |
| Inventive steels | 6 | 0.05 | 0.06 | 0.05 | 0.090 | 1.05 | 1.31 | 0.11 | 0.24 | 0.06 | 0.80 | 0.007 | 0.003 | 0.011 | 0.008 | 0.006 |
| | 7 | 0.06 | 0.06 | 0.07 | 0.110 | 0.96 | 1.41 | 0.15 | 0.24 | 0.07 | 0.70 | 0.006 | 0.004 | 0.009 | 0.007 | 0.004 |
| | 8 | 0.07 | 0.07 | 0.06 | 0.070 | 2.23 | 1.83 | 0.08 | 0.23 | 0.06 | 0.20 | 0.006 | 0.003 | 0.012 | 0.008 | 0.005 |
| | 9 | 0.05 | 0.08 | 0.30 | 0.080 | 2.12 | 1.48 | 0.18 | 0.25 | 0.08 | 0.60 | 0.006 | 0.003 | 0.008 | 0.007 | 0.007 |
| | 10 | 0.06 | 0.10 | 0.35 | 0.040 | 2.30 | 1.58 | 0.50 | 0.22 | 0.07 | 1.00 | 0.007 | 0.003 | 0.006 | 0.009 | 0.004 |
| | 11 | 0.06 | 0.09 | 0.44 | 0.130 | 2.20 | 1.10 | 0.51 | 0.23 | 0.06 | 0.70 | 0.006 | 0.003 | 0.004 | 0.008 | 0.005 |
| | 12 | 0.04 | 0.15 | 0.48 | 0.120 | 2.14 | 2.34 | 0.18 | 0.24 | 0.07 | 0.97 | 0.009 | 0.003 | 0.006 | 0.008 | 0.006 |
| | 13 | 0.06 | 0.30 | 0.44 | 0.110 | 2.89 | 1.62 | 0.12 | 0.21 | 0.08 | 0.60 | 0.004 | 0.003 | 0 008 | 0 009 | 0 005 |
| | 14 | 0.10 | 0.31 | 0.47 | 0.100 | 2.13 | 1.61 | 0.13 | 0.20 | 0.10 | 0.60 | 0.008 | 0.003 | 0.007 | 0.007 | 0.005 |
| | 15 | 0.11 | 0.24 | 0.51 | 0.220 | 2.14 | 1.73 | 0.11 | 0.23 | 0.07 | 1.00 | 0.008 | 0.003 | 0.008 | 0.009 | 0.006 |
| | 16 | 0.11 | 0.05 | 0.07 | 0.130 | 2.05 | 1.41 | 0.13 | 0.24 | 0.07 | 0.70 | 0.007 | 0.004 | 0.004 | 0.007 | 0.004 |
| | 17 | 0.11 | 0.07 | 0.05 | 0.080 | 2.24 | 2.38 | 0.53 | 0.21 | 0.05 | 0.60 | 0.007 | 0.004 | 0.005 | 0.008 | 0.005 |

In order to compare mechanical properties, tension tests, Charpy impact tests and creep rupture tests were performed on the comparative steels and inventive steels shown in Table 1. For use in the tension tests and the creep rupture tests, test pieces having a diameter of 6 mm and a gage length of 30 mm were cut out from the plates along their length. The tension tests were performed at room temperature and 600° C. In the creep rupture tests, long-time creep rupture tests were performed at 500° C., 550° C., 600° C. and 650° C. for a period of time up to about $10^4$ hours, and the 600° C.$\times 10^5$ hour creep rupture strength was determined by interpolation. In the Charpy impact tests, No. 4 test pieces were cut out from the plates along their length and used to determine the ductile-brittle fracture appearance transition temperature according to JIS Z2202.

Moreover, in order to evaluate welability, y-type weld cracking tests according to JIS Z3158 were preformed by using 20 mm thick test plates and preheating temperatures of 20° C., 50° C., 100° C., 150° C. and 200° C. The temperature at which the rate of section cracking became 0% was regarded as the crack prevention temperature and used to evaluate weldability.

The test results thus obtained are shown in Table 2. With respect to tensile strength and 0.2% yield strength, the inventive steels have strength equal to or higher than that of the comparative steels. A similar tendency is observed in the results of the high-temperature tension tests at 600° C. It can also be seen that, with respect to 600° C. creep rupture strength which indicates high-temperature strength, the inventive steels have much higher strength than the conventional steels.

As to weldability, the y-type weld cracking tests have revealed that all of the comparative steels require preheating at 150° C. or higher, whereas cracking of the inventive steels can be prevented by preheating at 20°–100° C. Moreover, it can be seen that steel samples having a lower C content have a lower crack prevention temperature.

EXAMPLE 2

50 kg each of steels having the respective chemical compositions shown in Tables 3 and 4 were melted in a vacuum melting furnace, and the resulting ingots were forged at 1,150°–950° C. to form plates having a thickness of 20 mm.

Steel No. 18 is carbon steel, and steel Nos. 19 to 21 are typical conventional low-Cr ferritic steels which have compositions corresponding to those of STBA 13, STBA 20, STBA 22 and STBA 24, respectively, of JIS (Japanese Industrial Standards). Steel Nos. 22 to 32 are comparative steels in which the contents of alloy components are modified so as to be outside the scope of the present invention. Steel Nos. 33 to 46 shown in Table 4 are low-Cr ferritic steels in accordance with the present invention.

TABLE 2

Test results of comparative steels and inventive steels

| | | Tension test at room temperature | | | Tension test at 600° C. | | | 600° C. × | Crack prevention |
|---|---|---|---|---|---|---|---|---|---|
| | No. | Tensile strength (kgf/mm²) | 0.2% yield strength (kgf/mm²) | Elongation (%) | Tensile strength (kgf/mm²) | 0.2% yield strength (kgf/mm²) | Elongation (%) | 100,000 h creep rupture strength (kgf/mm²) | temperature in y-type weld cracking test (°C.) |
| Comparative steels | 1 | 48.9 | 32.5 | 38 | 30.0 | 20.5 | 44 | 2.0 | 150≦ |
| | 2 | 57.0 | 35.4 | 33 | 31.1 | 25.6 | 49 | 3.8 | 150≦ |
| | 3 | 65.7 | 52.1 | 26 | 44.8 | 39.8 | 27 | 5.1 | 150≦ |
| | 4 | 68.3 | 57.2 | 24 | 46.2 | 40.8 | 24 | 5.4 | 150≦ |
| | 5 | 66.8 | 55.8 | 27 | 45.5 | 40.2 | 28 | 4.9 | 150≦ |
| Inventive steels | 6 | 67.1 | 52.3 | 32 | 42.3 | 37.8 | 24 | 8.0 | 20≦ |
| | 7 | 66.5 | 50.7 | 29 | 45.1 | 41.2 | 26 | 8.2 | 20≦ |
| | 8 | 68.9 | 55.7 | 31 | 43.8 | 39.2 | 25 | 8.0 | 20≦ |
| | 9 | 65.4 | 56.3 | 29 | 44.1 | 40.2 | 28 | 8.8 | 20≦ |
| | 10 | 67.2 | 53.8 | 28 | 43.9 | 37.8 | 27 | 8.6 | 20≦ |
| | 11 | 68.1 | 55.1 | 22 | 46.5 | 43.4 | 29 | 9.2 | 20≦ |
| | 12 | 77.8 | 58.1 | 24 | 53.1 | 49.1 | 23 | 9.3 | 20≦ |
| | 13 | 64.3 | 54.7 | 27 | 46.7 | 42.6 | 23 | 9.4 | 20≦ |
| | 14 | 65.1 | 51.8 | 23 | 48.7 | 44.1 | 24 | 9.7 | 100≦ |
| | 15 | 67.1 | 54.5 | 25 | 46.2 | 41.3 | 26 | 9.1 | 100≦ |
| | 16 | 63.8 | 50.2 | 28 | 47.3 | 43.1 | 28 | 8.8 | 100≦ |
| | 17 | 79.5 | 68.9 | 25 | 55.3 | 50.1 | 22 | 8.2 | 100≦ |

It can be seen from the results of Example 1 that the steels of the present invention have much greater high-temperature strength and more excellent weldability than conventional steels, and are hence highly economical materials which have excellent oxidation resistance and permit a reduction in the wall thickness of heat-resisting parts and a lowering of the preheating temperature required for welding.

As a conventional heat treatment, steel Nos. 18 and 19 were normalized by heating at 920° C. for 1 hour and air cooling (AC), and then tempered by heating at 740° C. for 1 hour and air cooling (AC). Steel Nos. 20 to 32 and the inventive steels were normalized by heating at 1,050° C. for 1 hour and air cooling (AC), and then tempered by heating at 770° C. for 1 hour and air cooling (AC).

TABLE 3

Chemical compositions of samples (comparative steels) (wt. %)

| | No. | C | Si | Mn | Ni | Cr | W | Mo | Re | V | Nb | Al | B | N | P | S |
|---|---|---|---|---|---|---|---|---|---|---|---|---|---|---|---|---|
| Comparative steels | 18 | 0.18 | 0.28 | 0.51 | — | — | — | 0.51 | — | — | — | 0.007 | — | 0.010 | 0.014 | 0.013 |
| | 19 | 0.13 | 0.25 | 0.47 | — | 0.67 | — | 0.53 | — | — | — | 0.006 | — | 0.013 | 0.018 | 0.011 |
| | 20 | 0.14 | 0.27 | 0.53 | 0.009 | 0.95 | — | 0.56 | — | — | — | 0.005 | — | 0.010 | 0.018 | 0.006 |
| | 21 | 0.12 | 0.28 | 0.46 | 0.010 | 2.32 | — | 0.98 | — | — | — | 0.006 | — | 0.015 | 0.013 | 0.004 |
| | 22 | 0.09 | 0.21 | 0.43 | 0.015 | 0.78 | — | 0.47 | — | 0.23 | 0.05 | 0.004 | 0.004 | 0.021 | 0.011 | 0.014 |
| | 23 | 0.09 | 0.18 | 0.44 | 0.020 | 1.06 | — | 0.56 | — | 0.21 | 0.05 | 0.008 | 0.005 | 0.022 | 0.009 | 0.006 |
| | 24 | 0.19 | 0.17 | 0.53 | 0.014 | 1.21 | 1.02 | — | — | — | — | 0.012 | — | 0.011 | 0.008 | 0.008 |
| | 25 | 0.14 | 0.12 | 0.56 | 0.090 | 1.20 | 0.51 | — | — | — | — | 0.007 | 0.010 | 0.013 | 0.014 | 0.014 |
| | 26 | 0.06 | 0.14 | 0.28 | 1.530 | 1.33 | 0.10 | 2.41 | — | 0.18 | 0.04 | 0.007 | 0.012 | 0.007 | 0.013 | 0.009 |
| | 27 | 0.05 | 0.13 | 0.37 | 0.034 | 1.04 | 0.22 | 3.22 | — | 9.14 | 0.09 | 0.004 | 0.030 | 0.006 | 0.008 | 0.013 |
| | 28 | 0.06 | 0.09 | 1.23 | 0.025 | 0.93 | 1.47 | 0.83 | — | 0.27 | 0.23 | 0.005 | 0.005 | 0.008 | 0.007 | 0.014 |
| | 29 | 0.06 | 0.08 | 0.51 | 0.180 | 0.97 | 1.28 | 0.17 | — | 0.30 | 0.41 | 0.009 | 0.004 | 0.011 | 0.017 | 0.011 |

TABLE 3-continued

| Chemical compositions of samples (comparative steels) (wt. %) | | | | | | | | | | | | | | | |
|---|---|---|---|---|---|---|---|---|---|---|---|---|---|---|---|
| No. | C | Si | Mn | Ni | Cr | W | Mo | Re | V | Nb | Al | B | N | P | S |
| 30 | 0.07 | 0.41 | 0.62 | 0.340 | 1.03 | 1.71 | 0.33 | — | 0.22 | 0.38 | 0.008 | — | 0.040 | 0.011 | 0.005 |
| 31 | 0.08 | 0.75 | 0.38 | 0.070 | 1.43 | 1.05 | 0.67 | — | 0.29 | 0.09 | 0.009 | 0.007 | 0.050 | 0.015 | 0.007 |
| 32 | 0.06 | 0.65 | 0.28 | 0.140 | 1.66 | 3.19 | 0.70 | 0.34 | 0.22 | 0.05 | 0.004 | 0.004 | 0.021 | 0.013 | 0.008 |

TABLE 4

| Chemical compositions of samples (inventive steels) (wt. %) | | | | | | | | | | | | | | | | |
|---|---|---|---|---|---|---|---|---|---|---|---|---|---|---|---|---|
| | No. | C | Si | Mn | Ni | Cr | W | Mo | Re | V | Nb | Al | B | N | P | S |
| Inventive steels | 33 | 0.07 | 0.37 | 0.10 | 0.190 | 1.93 | 2.17 | 1.05 | 0.10 | 0.18 | 0.04 | 0.006 | 0.009 | 0.018 | 0.011 | 0.011 |
| | 34 | 0.05 | 0.06 | 0.05 | 0.090 | 0.38 | 1.31 | 1.47 | 0.03 | 0.24 | 0.06 | 0.007 | 0.005 | 0.011 | 0.008 | 0.006 |
| | 35 | 0.06 | 0.06 | 0.07 | 0.110 | 0.55 | 1.41 | 0.38 | 0.23 | 0.24 | 0.07 | 0.006 | 0.004 | 0.009 | 0.007 | 0.004 |
| | 36 | 0.07 | 0.07 | 0.06 | 0.970 | 0.71 | 1.83 | 2.19 | 0.51 | 0.23 | 0.06 | 0.006 | 0.008 | 0.012 | 0.008 | 0.005 |
| | 37 | 0.05 | 0.08 | 0.25 | 0.880 | 0.99 | 1.48 | 0.18 | 0.78 | 0.25 | 0.08 | 0.006 | 0.009 | 0.008 | 0.007 | 0.007 |
| | 38 | 0.06 | 0.10 | 0.09 | 0.020 | 1.05 | 1.58 | 1.50 | 0.14 | 0.22 | 0.07 | 0.007 | 0.008 | 0.006 | 0.009 | 0.004 |
| | 39 | 0.06 | 0.09 | 0.06 | 0.130 | 1.10 | 0.10 | 2.55 | 0.08 | 0.23 | 0.06 | 0.006 | 0.002 | 0.004 | 0.008 | 0.005 |
| | 40 | 0.04 | 0.65 | 0.07 | 0.120 | 1.21 | 2.34 | 0.18 | 0.12 | 0.24 | 0.07 | 0.009 | 0.003 | 0.006 | 0.008 | 0.006 |
| | 41 | 0.06 | 0.30 | 0.88 | 0.110 | 1.33 | 1.62 | 0.12 | 0.59 | 0.11 | 0.18 | 0.004 | 0.004 | 0.008 | 0.009 | 0.005 |
| | 42 | 0.06 | 0.31 | 0.33 | 0.100 | 1.46 | 1.61 | 0.13 | 0.87 | 0.47 | 0.10 | 0.008 | 0.005 | 0.007 | 0.007 | 0.005 |
| | 43 | 0.09 | 0.24 | 0.51 | 0.520 | 1.13 | 1.73 | 0.06 | 0.60 | 0.23 | 0.07 | 0.008 | 0.005 | 0.008 | 0.009 | 0.006 |
| | 44 | 0.07 | 0.07 | 0.07 | 0.130 | 1.00 | 1.41 | 0.13 | 1.23 | 0.24 | 0.07 | 0.007 | 0.006 | 0.004 | 0.007 | 0.004 |
| | 45 | 0.08 | 0.05 | 0.05 | 0.180 | 1.12 | 2.38 | 0.53 | 1.41 | 0.31 | 0.05 | 0.007 | 0.007 | 0.005 | 0.008 | 0.005 |
| | 46 | 0.11 | 0.05 | 0.08 | 0.150 | 1.05 | 1.63 | 0.11 | 1.03 | 0.26 | 0.06 | 0.008 | 0.006 | 0.004 | 0.097 | 0.006 |

In order to compare mechanical properties, tension tests, creep rupture tests, and Charpy impact tests of the welding heat-affected zone were performed on the comparative steels and inventive steels shown in Tables 3 and 4. Moreover, y-type weld cracking tests were performed in order to evaluate weldability. For use in the tension tests and the creep rupture tests, test pieces having a diameter of 6 mm and a gage length of 30 mm were cut out from the plates along their length. The tension tests were performed at room temperature and 600° C. In the creep rupture tests, long-time rupture tests were performed at 500° C., 550° C., 600° C. and 650° C. for a period of time up to about 10,000 hours, and the 600° C.×10,000 hour creep rupture strength was determined. The Charpy impact tests were performed according to JIS Z2202. That is, using No. 4 test pieces, the impact value at 0° C. was measured by regarding the notch position as the middle of the welding heat-affected zone.

The y-type weld cracking tests were performed according to JIS Z3158 by using a plate thickness of 20 mm and preheating temperatures of 20° C., 50° C., 100° C., 150° C. and 200° C. The temperature at which the rate of longitudinal section cracking became 0% was regarded as the crack prevention temperature and used to evaluate weldability.

The test results thus obtained are shown in Tables 5 and 6. With respect to tensile strength and 0.2% yield strength, the inventive steels have strength equal to or higher than that of the comparative steels. A similar tendency is observed in the results of the high-temperature tension tests at 600° C. With respect to 600° C.×10,000 hour creep rupture strength which indicates high-temperature strength, the comparative steels including conventional steels have values of at most 9.7 kgf/mm$^2$. In contrast, the inventive steels have values of at least 13.7 kgf/mm$^2$ or greater, indicating a marked improvement in high-temperature creep rupture strength.

As to weldability, the y-type weld cracking tests have revealed that, in order to prevent the occurrence of cracking, the comparative steels require preheating at 50° C. or above, but the inventive steels undergo no cracking even at 20° C. Thus, it can be seen that the inventive steels have excellent weldability. This suggests that they can be welded at room temperature, i.e., without preheating. With respect to the impact value at 0° C. of the welding heat-affected zone, all the inventive steels are higher than the comparative steels, indicating that they are also excellent in the impact resistance of the welding heat-affected zone.

TABLE 5

Test results of comparative steels

| | No. | Tension test at room temperature: Tensile strength (kgf/mm²) | 0.2% yield strength (kgf/mm²) | Elongation (%) | Tension test at 600° C.: Tensile strength (kgf/mm²) | 0.2% yield strength (kgf/mm²) | Elongation (%) | 600° C. × 100,000 h creep rupture strength (kgf/mm²) | Crack prevention temperature in y-type weld cracking test (°C.) | Impact value at 0° C. of welding heat-affected zone (J/cm²) |
|---|---|---|---|---|---|---|---|---|---|---|
| Comparative steels | 18 | 54.3 | 37.1 | 28 | 28.7 | 24.1 | 47 | 4.3 | 150≦ | 29 |
| | 19 | 51.8 | 35.6 | 31 | 27.6 | 23.8 | 43 | 6.3 | 150≦ | 28 |
| | 20 | 65.7 | 52.1 | 26 | 44.8 | 39.8 | 27 | 7.5 | 150≦ | 52 |
| | 21 | 68.3 | 57.2 | 24 | 46.2 | 40.8 | 24 | 7.8 | 150≦ | 41 |
| | 22 | 66.8 | 55.8 | 27 | 45.5 | 40.2 | 28 | 8.2 | 150≦ | 62 |
| | 23 | 67.1 | 52.3 | 32 | 42.3 | 37.8 | 24 | 8.0 | 100≦ | 54 |
| | 24 | 66.5 | 50.7 | 29 | 45.1 | 41.2 | 26 | 8.2 | 100≦ | 17 |
| | 25 | 78.0 | 65.5 | 25 | 55.8 | 48.3 | 25 | 8.0 | 100≦ | 62 |
| | 26 | 65.4 | 56.3 | 29 | 44.1 | 40.2 | 28 | 8.8 | 100≦ | 73 |
| | 27 | 67.2 | 53.8 | 28 | 43.9 | 37.8 | 27 | 8.6 | 50≦ | 132 |
| | 28 | 68.1 | 55.1 | 22 | 46.5 | 43.4 | 29 | 9.2 | 50≦ | 154 |
| | 29 | 77.8 | 58.1 | 24 | 53.1 | 49.1 | 23 | 9.3 | 100≦ | 109 |
| | 30 | 64.3 | 54.7 | 27 | 46.7 | 42.6 | 23 | 9.4 | 100≦ | 98 |
| | 31 | 65.1 | 51.8 | 23 | 48.7 | 44.1 | 24 | 9.7 | 100≦ | 86 |
| | 32 | 76.1 | 55.8 | 21 | 56.6 | 50.7 | 23 | 8.9 | 100≦ | 72 |

TABLE 6

Test results of inventive steels

| | No. | Tension test at room temperature: Tensile strength (kgf/mm²) | 0.2% yield strength (kgf/mm²) | Elongation (%) | Tension test at 600° C.: Tensile strength (kgf/mm²) | 0.2% yield strength (kgf/mm²) | Elongation (%) | 600° C. × 100,000 h creep rupture strength (kgf/mm²) | Crack prevention temperature in y-type weld cracking test (°C.) | Impact value at 0° C. of welding heat-affected zone (J/cm²) |
|---|---|---|---|---|---|---|---|---|---|---|
| Inventive steels | 33 | 75.4 | 58.4 | 20 | 54.3 | 49.2 | 22 | 9.6 | 100≦ | 67 |
| | 34 | 68.1 | 54.5 | 28 | 40.9 | 37.2 | 30 | 14.1 | 20≦ | 205 |
| | 35 | 69.1 | 54.6 | 29 | 41.5 | 37.3 | 28 | 13.7 | 20≦ | 184 |
| | 36 | 68.3 | 55.3 | 29 | 41.2 | 36.3 | 32 | 14.1 | 20≦ | 234 |
| | 37 | 71.2 | 57.0 | 24 | 42.7 | 38.9 | 29 | 14.4 | 20≦ | 231 |
| | 38 | 69.4 | 57.6 | 30 | 41.6 | 38.3 | 27 | 14.6 | 20≦ | 209 |
| | 39 | 71.3 | 62.0 | 28 | 42.8 | 37.6 | 29 | 14.4 | 20≦ | 248 |
| | 40 | 66.7 | 53.4 | 33 | 39.6 | 36.0 | 31 | 14.3 | 20≦ | 249 |
| | 41 | 70.2 | 53.4 | 27 | 41.7 | 37.5 | 30 | 14.9 | 20≦ | 230 |
| | 42 | 69.8 | 55.8 | 27 | 40.8 | 37.5 | 28 | 16.1 | 20≦ | 214 |
| | 43 | 71.2 | 59.8 | 30 | 44.2 | 40.2 | 30 | 15.1 | 20≦ | 238 |
| | 44 | 71.4 | 60.0 | 28 | 42.9 | 37.3 | 29 | 14.9 | 20≦ | 242 |
| | 45 | 73.8 | 58.3 | 27 | 46.1 | 42.0 | 30 | 16.3 | 20≦ | 203 |
| | 46 | 73.1 | 59.2 | 26 | 47.2 | 42.5 | 26 | 16.9 | 20≦ | 184 |

It can be seen from the results of Example 2 that the steels of the present invention have much greater high-temperature strength and more excellent weldability than conventional steels, and are hence materials which permit a reduction in the wall thickness of heat-resisting parts and a lowering of the preheating temperature required for welding.

EXAMPLE 3

30 kg each of steels having the respective chemical compositions shown in Tables 7 and 8 were melted in a vacuum melting furnace. The resulting ingots were cast into the form of Y-type test pieces and then cooled slowly.

Steel Nos. 47 and 48 are typical conventional cast steels which correspond to SCPH 21 and SCPH 32, respectively, of JIS. Steel Nos. 49 and 50 have chemical compositions corresponding to that of a heat-resisting steel for small-diameter pipes which is used in boilers and the like. Steel Nos. 51 to 62 are comparative cast steels in which the contents of alloy components are modified so as to be outside the scope of the present invention. Steel Nos. 63 to 75 shown in Table 8 are low-Cr ferritic cast steels in accordance with the present invention.

As a conventional heat treatment, steel Nos. 47 to 50 were normalized by heating at 950° C. for 2 hours and air cooling (AC), and then tempered by heating at 730° C. for 2 hours and air cooling (AC). The inventive steel Nos. 63 to 75 were normalized by heating at 1,050° C. for 2 hours and air cooling (AC), and then tempered by heating at 770° C. for 1.5 hours and air cooling (AC).

TABLE 7

Chemical compositions of samples (comparative cast steels) (wt. %)

| | No. | C | Si | Mn | Ni | Cr | W | Mo | Re | V | Nb | Al | B | N | P | S |
|---|---|---|---|---|---|---|---|---|---|---|---|---|---|---|---|---|
| Comparative cast steels | 47 | 0.15 | 0.43 | 0.51 | — | — | — | 0.53 | — | — | — | 0.007 | — | 0.010 | 0.020 | 0.013 |
| | 48 | 0.12 | 0.44 | 0.65 | — | 2.51 | — | 1.01 | — | — | — | 0.012 | — | — | 0.021 | 0.005 |
| | 49 | 0.13 | 0.36 | 0.45 | 0.010 | 0.95 | — | 0.56 | — | — | — | 0.005 | — | 0.011 | 0.018 | 0.006 |
| | 50 | 0.12 | 0.34 | 0.45 | 0.010 | 2.19 | — | 0.98 | — | — | — | 0.006 | — | 0.016 | 0.014 | 0.003 |
| | 51 | 0.09 | 0.83 | 0.43 | 0.015 | 0.95 | — | 0.47 | — | 0.23 | 0.05 | 0.004 | 0.004 | 0.021 | 0.011 | 0.014 |
| | 52 | 0.09 | 0.67 | 0.44 | 0.020 | 1.06 | — | 0.56 | — | 0.21 | 0.05 | 0.008 | 0.005 | 0.022 | 0.009 | 0.006 |
| | 53 | 0.19 | 0.48 | 0.53 | 0.014 | 1.54 | 1.02 | — | — | — | — | 0.012 | — | 0.060 | 0.008 | 0.008 |
| | 54 | 0.14 | 0.41 | 0.56 | 0.090 | 1.87 | 0.51 | — | — | — | — | 0.007 | 0.010 | 0.040 | 0.014 | 0.014 |
| | 55 | 0.06 | 0.28 | 0.28 | 1.530 | 2.06 | 0.12 | 2.38 | — | 0.18 | 0.04 | 0.007 | 0.012 | 0.007 | 0.013 | 0.009 |
| | 56 | 0.05 | 0.34 | 0.37 | 1.350 | 2.23 | 0.22 | 3.10 | — | 0.14 | 0.09 | 0.604 | 0.030 | 0.006 | 0.008 | 0.013 |
| | 57 | 0.06 | 0.09 | 1.23 | 0.025 | 2.42 | 1.47 | 0.93 | — | 0.27 | 0.23 | 0.005 | 0.005 | 0.008 | 0.007 | 0.014 |
| | 58 | 0.06 | 0.08 | 0.51 | 0.180 | 2.35 | 1.28 | 0.21 | — | 0.30 | 0.41 | 0.009 | 0.004 | 0.011 | 0.017 | 0.011 |
| | 59 | 0.07 | 0.41 | 0.62 | 0.340 | 2.87 | 1.71 | 0.32 | — | 0.22 | 0.38 | 0.008 | — | 0.040 | 0.011 | 0.005 |
| | 60 | 0.08 | 0.75 | 0.38 | 0.380 | 2.21 | 1.05 | 0.66 | — | 0.29 | 0.09 | 0.009 | 0.007 | 0.050 | 0.015 | 0.007 |
| | 61 | 0.06 | 0.65 | 0.28 | 0.410 | 2.90 | 3.19 | 0.68 | 0.34 | 0.22 | 0.05 | 0.004 | 0.004 | 0.021 | 0.013 | 0.008 |
| | 62 | 0.07 | 0.37 | 0.10 | 0.530 | 3.45 | 2.17 | 1.09 | 0.10 | 0.18 | 0.04 | 0.006 | 0.007 | 0.018 | 0.011 | 0.011 |

TABLE 8

Chemical compositions of samples (inventive cast steels) (wt. %)

| | No. | C | Si | Mn | Ni | Cr | W | Mo | Re | V | Nb | Al | B | N | P | S |
|---|---|---|---|---|---|---|---|---|---|---|---|---|---|---|---|---|
| Inventive cast steels | 63 | 0.05 | 0.21 | 0.08 | 0.120 | 1.05 | 1.31 | 0.23 | 0.23 | 0.04 | 0.06 | 0.007 | 0.005 | 0.011 | 0.008 | 0.006 |
| | 64 | 0.06 | 0.18 | 0.23 | 0.320 | 1.98 | 1.41 | 0.24 | 0.78 | 0.14 | 0.07 | 0.006 | 0.004 | 0.009 | 0.007 | 0.004 |
| | 65 | 0.07 | 0.39 | 0.13 | 0.780 | 1.45 | 1.83 | 0.38 | 0.40 | 0.23 | 0.06 | 0.006 | 0.008 | 0.022 | 0.008 | 0.005 |
| | 66 | 0.05 | 0.47 | 0.80 | 0.500 | 2.31 | 1.48 | 0.51 | 0.38 | 0.25 | 0.08 | 0.006 | 0.009 | 0.008 | 0.007 | 0.007 |
| | 67 | 0.06 | 0.31 | 0.55 | 0.530 | 2.24 | 1.58 | 0.11 | 0.91 | 0.22 | 0.07 | 0.041 | 0.008 | 0.006 | 0.009 | 0.004 |
| | 68 | 0.06 | 0.39 | 0.46 | 0.360 | 2.15 | 1.12 | 0.12 | 0.66 | 0.23 | 0.06 | 0.006 | 0.001 | 0.004 | 0.008 | 0.005 |
| | 69 | 0.04 | 0.46 | 0.92 | 0.470 | 2.06 | 2.34 | 0.34 | 0.15 | 0.24 | 0.07 | 0.009 | 0.003 | 0.006 | 0.008 | 0.006 |
| | 70 | 0.06 | 0.43 | 0.88 | 0.160 | 2.60 | 1.62 | 0.95 | 0.52 | 0.11 | 0.18 | 0.020 | 0.004 | 0.008 | 0.009 | 0.005 |
| | 71 | 0.06 | 0.21 | 0.21 | 0.980 | 2.78 | 1.61 | 2.34 | 0.78 | 0.47 | 0.10 | 0.008 | 0.005 | 0.007 | 0.007 | 0.005 |
| | 72 | 0.09 | 0.42 | 0.08 | 0.520 | 2.91 | 1.73 | 0.18 | 0.60 | 0.23 | 0.07 | 0.008 | 0.005 | 0.008 | 0.009 | 0.006 |
| | 73 | 0.07 | 0.57 | 0.35 | 0.420 | 2.06 | 1.41 | 0.11 | 1.13 | 0.24 | 0.07 | 0.007 | 0.006 | 0.004 | 0.007 | 0.004 |
| | 74 | 0.08 | 0.66 | 0.45 | 0.180 | 2.16 | 2.78 | 0.13 | 1.44 | 0.31 | 0.05 | 0.007 | 0.007 | 0.005 | 0.008 | 0.005 |
| | 75 | 0.11 | 0.17 | 0.18 | 0.220 | 2.32 | 1.73 | 0.17 | 0.48 | 0.26 | 0.06 | 0.008 | 0.008 | 0.004 | 0.006 | 0.006 |

In order to compare mechanical properties, tension tests at room temperature, Charpy impact tests and creep rupture tests were performed on the comparative cast steels and inventive cast steels shown in Tables 7 and 8. Moreover, y-type weld cracking tests were performed in order to evaluate weldability. For use in the tension tests at room temperature and the creep rupture tests, test pieces having a diameter of 6 mm and a gage length of 30 mm were cut out from the Y-type test pieces in a direction perpendicular to the direction of solidification. The tension tests were performed at room temperature. In the creep rupture tests, long-time rupture tests were performed at 500° C., 550° C., 600° C. and 650° C. for a period of time up to about 10,000 hours, and the 600° C.×10,000 hour creep rupture strength was determined. The Charpy impact tests were performed according to JIS Z2202. That is, using No. 4 test pieces, the impact value at 0° C. was measured three times by placing the test pieces so that the direction of the notch was perpendicular to the direction of solidification. Then, the average of the three impact values was obtained.

The y-type weld cracking tests were performed according to JIS Z3158 by using a plate thickness of 20 mm and preheating temperatures of 20° C., 50° C., 100° C., 150° C. and 200° C. The temperature at which the rate of longitudinal section cracking became 0% was regarded as the crack prevention temperature and used to evaluate weldability.

The test results thus obtained are shown in Tables 9 and 10. With respect to tensile strength and 0.2% yield strength as evaluated by the tension tests at room temperature, the inventive cast steels have strength equal to or higher than that of the comparative cast steels. With respect to 600° C.×10,000 hour creep rupture strength which indicates high-temperature strength, the comparative steels including conventional steels have values of at most 9.5 kgf/mm$^2$. In contrast, the inventive steels have values of 13.3 kgf/mm$^2$ or greater, indicating a marked improvement in high-temperature creep rupture strength.

Of the comparative cast steels, Nos. 61 and 62 contain all of the constituent elements of the inventive cast steels, but Cr and W are added in amounts beyond the limits of the present invention. They have relatively high creep rupture strength, but are inferior when compared with the inventive cast steels.

The impact values of the comparative cast steels are 146 J/cm$^2$ or less. In contrast, all of the inventive cast steels exhibit impact values of 191 J/cm$^2$ or greater, indicating that they have excellent toughness at low temperatures.

As to weldability, the y-type weld cracking tests have revealed that, in order to prevent the occurrence of cracking, all of the comparative steels require preheating at 50° C. or above, but the inventive steels undergo no cracking even at 20° C. Thus, it can be seen that the inventive steels have excellent weldability and their preheating during welding may be omitted.

TABLE 9

Test results of comparative cast steels

| | No. | Tension test at room temperature: Tensile strength (kgf/mm$^2$) | 0.2% yield strength (kgf/mm$^2$) | Elongation (%) | 600° C. × 10,000 h creep rupture strength (kgf/mm$^2$) | Impact value (0° C.) in Charpy impact test (J/cm$^2$) | Crack prevention temperature in y-type weld cracking test (°C.) |
|---|---|---|---|---|---|---|---|
| Comparative cast steels | 47 | 48.8 | 31.0 | 38 | 3.6 | 29 | 150≦ |
| | 48 | 57.0 | 33.8 | 33 | 7.1 | 34 | 150≦ |
| | 49 | 65.7 | 49.8 | 26 | 7.6 | 48 | 150≦ |
| | 50 | 68.2 | 59.8 | 24 | 7.4 | 56 | 150≦ |
| | 51 | 66.8 | 58.2 | 27 | 7.4 | 69 | 150≦ |
| | 52 | 67.1 | 54.6 | 32 | 8.2 | 53 | 100≦ |
| | 53 | 66.5 | 52.9 | 29 | 8.0 | 35 | 100≦ |
| | 54 | 77.9 | 59.2 | 25 | 7.1 | 68 | 100≦ |
| | 55 | 65.4 | 51.0 | 29 | 8.2 | 80 | 100≦ |
| | 56 | 67.2 | 48.6 | 28 | 7.2 | 119 | 50≦ |
| | 57 | 68.0 | 49.9 | 22 | 7.9 | 146 | 50≦ |
| | 58 | 77.7 | 52.5 | 24 | 8.3 | 110 | 100≦ |
| | 59 | 64.2 | 49.5 | 27 | 8.6 | 97 | 100≦ |
| | 60 | 65.1 | 47.9 | 23 | 8.6 | 79 | 100≦ |
| | 61 | 67.1 | 54.1 | 25 | 8.6 | 112 | 50≦ |
| | 62 | 63.7 | 56.4 | 28 | 9.5 | 103 | 100≦ |

TABLE 10

Test results of inventive cast steels

| | No. | Tension test at room temperature: Tensile strength (kgf/mm$^2$) | 0.2% yield strength (kgf/mm$^2$) | Elongation (%) | 600° C. × 10,000 h creep rupture strength (kgf/mm$^2$) | Impact value (0° C.) in Charpy impact test (J/cm$^2$) | Crack prevention temperature in y-type weld cracking test (°C.) |
|---|---|---|---|---|---|---|---|
| Inventive cast steels | 63 | 68.8 | 55.1 | 28 | 13.3 | 198 | 20≦ |
| | 64 | 71.2 | 56.2 | 29 | 13.4 | 191 | 20≦ |
| | 65 | 71.3 | 57.7 | 28 | 13.8 | 222 | 20≦ |
| | 66 | 72.2 | 57.7 | 26 | 14.2 | 231 | 20≦ |
| | 67 | 69.6 | 57.8 | 30 | 14.3 | 205 | 20≦ |
| | 68 | 74.5 | 64.9 | 28 | 14.8 | 237 | 20≦ |
| | 69 | 77.4 | 61.9 | 31 | 14.7 | 241 | 20≦ |
| | 70 | 73.5 | 55.9 | 28 | 15.4 | 208 | 20≦ |
| | 71 | 71.2 | 56.9 | 26 | 15.2 | 197 | 20≦ |
| | 72 | 74.5 | 62.6 | 29 | 16.2 | 223 | 20≦ |
| | 73 | 75.7 | 63.5 | 27 | 17.1 | 242 | 20≦ |
| | 74 | 75.3 | 59.5 | 28 | 16.3 | 220 | 20≦ |
| | 75 | 76.3 | 61.8 | 26 | 16.4 | 189 | 20≦ |

It can be seen from the results of Example 3 that the cast steels of the present invention have much greater high-temperature strength and more excellent impact resistance and weldability than conventional steels.

We claim:

1. A low-Cr ferritic steel consisting essentially of, on a weight percentage basis, 0.03 to 0.12% C, 0.05 to 0.7% Si, 0.05 to 1% Mn, 0.002 to 0.025% P, 0.001 to 0.015% S, 0.3 to 3% Cr, 0.01 to 1% Ni, 0.05 to 3% Mo, 0.01 to 0.5% V, 0.1 to 3% W, 0.01 to 0.2% Nb, 0.1 to 1.5% Re, 0.003 to 0.05% Al, 0.0001 to 0.01% B, 0.003 to 0.03% N, and the balance being Fe and incidental impurities.

2. A low-Cr ferritic steel consisting essentially of, on a weight percentage basis, 0.03 to 0.12% C, 0.05 to 0.7% Si, 0.05 to 1% Mn, 0.002 to 0.025% P, 0.001 to 0.015% S, 0.3 to 1.5% Cr, 0.01 to 1% Ni, 0.05 to 3% Mo, 0.01 to 0.5% V, 0.1 to 3% W, 0.01 to 0.2% Nb, 0.02 to 1.5% Re, 0.003 to 0.05% Al, 0.0001 to 0.01% B, 0.003 to 0.03% N, and the balance being Fe and incidental impurities.

3. A low-Cr ferritic cast steel consisting essentially of, on a weight percentage basis, 0.03 to 0.12% C, 0.05 to 0.7% Si, 0.05 to 1% Mn, 0.002 to 0.025% P, 0.001 to 0.015% S, 0.3 to 3% Cr, 0.01 to 1% Ni, 0.05 to 3% Mo, 0.01 to 0.5% V, 0.1 to 3% W, 0.01 to 0.2% Nb, 0.02 to 1.5% Re, 0.003 to 0.05% Al, 0.0001 to 0.01% B, 0.003 to 0.03% N, and the balance being Fe and incidental impurities.

4. A low-Cr ferritic steel according to claim 1, wherein said content of carbon is in the range of from 0.04 to 0.08% by weight.

5. A low-Cr ferritic steel according to claim 1, wherein said content of Si is in the range of from 0.15 to 0.6% by weight.

6. A low-Cr ferritic steel according to claim 1, wherein said content of Mn is in the range of from 0.05 to 0.40% by weight.

7. A low-Cr ferritic steel according to claim 1, wherein said content of Cr is in the range of from 0.8 to 1.5% by weight.

8. A low-Cr ferritic steel according to claim 1, wherein said content of Ni is in the range of from 0.05 to 0.30% by weight.

9. A low-Cr ferritic steel according to claim 1, wherein said content of Mo is in the range of from 0.05 to 0.5% by weight.

10. A low-Cr ferritic steel according to claim 1, wherein said content of V is in the range of from 0.15 to 0.30% by weight.

11. A low-Cr ferritic steel according to claim 1, wherein said content of Nb is in the range of from 0.03 to 0.10% by weight.

12. A low-Cr ferritic steel according to claim 1, wherein said content of Al is in the range of from 0.003 to 0.01% by weight.

13. A low-Cr ferritic steel according to claim 1, wherein said content of N is in the range of from 0.003 to 0.01% by weight.

14. A low-Cr ferritic cast steel according to claim 3, wherein said content of Si is in the range of from 0.15 to 0.60% by weight.

15. A low-Cr ferritic cast steel according to claim 3, wherein said content of Mn is in the range of from 0.05 to 0.40% by weight.

16. A low-Cr ferritic cast steel according to claim 3, wherein said content of Cr is in the range of from 0.8 to 1.5% by weight.

17. A low-Cr ferritic cast steel according to claim 3, wherein said content of Ni is in the range of from 0.05 to 0.30% by weight.

18. A low-Cr ferritic cast steel according to claim 3, wherein said content of Mo is in the range of from 0.05 to 0.5% by weight.

19. A low-Cr ferritic cast steel according to claim 3, wherein said content of V is in the range of from 0.15 to 0.30% by weight.

20. A low-Cr ferritic cast steel according to claim 3, wherein said content of Nb is in the range of from 0.03 to 0.10% by weight.

21. A low-Cr ferritic cast steel according to claim 3, wherein said content of Al is in the range of from 0.003 to 0.01% by weight.

22. A low-Cr ferritic cast steel according to claim 3, wherein said content of N is in the range of from 0.003 to 0.01% by weight.

23. A low-Cr ferritic steel according to claim 1, wherein said content of Re is in the range of from 0.1 to 0.7% by weight.

24. A low-Cr ferritic cast steel according to claim 3, wherein said content of Re is in the range of from 0.2 to 0.7% by weight.

* * * * *